US006568208B1

(12) United States Patent
Fidkowski et al.

(10) Patent No.: US 6,568,208 B1
(45) Date of Patent: May 27, 2003

(54) SYSTEM AND METHOD FOR INTRODUCING LOW PRESSURE REFLUX TO A HIGH PRESSURE COLUMN WITHOUT A PUMP

(75) Inventors: Zbigniew Tadeusz Fidkowski, Macungie, PA (US); Paul Higginbotham, Guildford (GB)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/137,973

(22) Filed: May 3, 2002

(51) Int. Cl.[7] ..... F25J 3/00
(52) U.S. Cl. ..... 62/643; 62/651
(58) Field of Search ..... 62/643, 646, 648, 62/651

(56) References Cited

U.S. PATENT DOCUMENTS 4,595,405 A * 6/1986 Agrawal et al. ..... 62/646
4,796,431 A * 1/1989 Erickson ..... 62/651
5,098,457 A * 3/1992 Cheung et al. ..... 62/646
5,386,692 A * 2/1995 Laforce ..... 62/646
5,513,497 A * 5/1996 Agrawal et al. ..... 62/651
6,148,637 A 11/2000 Guillard et al.
6,196,022 B1 * 3/2001 Horst et al. ..... 62/643

* cited by examiner

*Primary Examiner*—William C Doerrler
(74) *Attorney, Agent, or Firm*—Willard Jones, II

(57) ABSTRACT

A method and system for producing nitrogen and/or oxygen by air separation. The system includes at least one high pressure column, at least one low pressure column, and a reboiler-condenser. The method includes generating a high pressure nitrogen stream from the high pressure column and using energy from the high pressure nitrogen stream to provide nitrogen reflux to the high pressure column.

25 Claims, 10 Drawing Sheets

FIGURE 1 - Prior Art

FIGURE 2 - Prior Art

FIGURE 3 - Prior Art

FIGURE 4 - Prior Art

FIGURE 5 - Prior Art

SYSTEM AND METHOD FOR INTRODUCING LOW PRESSURE REFLUX TO A HIGH PRESSURE COLUMN WITHOUT A PUMP

BACKGROUND OF THE INVENTION

This invention relates generally to air separation and more specifically to cryogenic air separation and nitrogen and/or oxygen production.

Frequently, in a column system for air separation, there is a need to introduce low-pressure nitrogen liquid to a high pressure column as reflux. Examples of column systems where this occurs include:

- Side-by-side column arrangements for the production of nitrogen and/or oxygen;
- Column systems for the production of nitrogen and/or oxygen with dual reboiler and nitrogen expansion; and
- Column systems for the production of high pressure nitrogen with nitrogen liquid reflux pumped from the low pressure column to the high pressure column.

These column arrangements are described in detail below.

In a typical air separation unit, for example the configuration shown in FIG. 1, there are at least two distillation columns: a high pressure column 110, and a low pressure column 120. These columns are heat integrated through reboiler-condenser 130 and the low pressure column is usually built on top of the high pressure column.

With the increasing trend toward higher efficiency distillation and higher purity of products, the height of the distillation column in such a configuration increases. The height of the combined high pressure-low pressure column system ultimately becomes so tall that the design of the entire system is prohibitively expensive. Stacking the columns is also not typically desired for larger plants, where the diameters of the columns are large and the columns are heavy.

To avoid these problems, conventional high pressure and low pressure columns can be built side-by-side. The reboiler-condenser can be located on top of the high pressure column (such as the configuration shown in FIG. 2) or in the bottom of the low pressure column (shown in FIG. 3). In both of these cases a pump is necessary. According to U.S. Pat. No. 6,148,637, and as shown in FIG. 2, liquid oxygen in stream 240 is pumped, using pump 250, from the bottom of low pressure column 220 to reboiler 230 located on top of high pressure column 210.

U.S. Pat. No. 6,148,637 discloses a three component system, comprised of a lower pressure column, a higher pressure column, and a heat exchanger. Included in this system is a pump for transporting liquid from the bottom of the lower pressure column to a vaporizer-condenser at the top of the higher pressure column.

As illustrated in FIG. 3, nitrogen liquid in stream 360 is pumped, using pump 350, from reboiler-condenser 330 located in the bottom of low pressure column 320 back to the top of high pressure column 310 as reflux. Usually two pumps instead of one are installed for the same service—a working pump and an idle nitrogen liquid pump that serves as a spare. Cryogenic liquid pumps are expensive, require periodic maintenance and, because they contain moving parts, are more likely to fail than stationary equipment.

A column system for the production of nitrogen and/or oxygen with a dual reboiler and nitrogen expansion has been described in U.S. Pat. No. 4,796,431, and is shown in FIG. 4. In this arrangement, air is introduced to high pressure column 410 and product nitrogen and oxygen are withdrawn from low pressure column 420. The columns are heat integrated by lower reboiler-condenser 430 and upper reboiler-condenser 440. Nitrogen in stream 432 from the top of high pressure column 410 is divided into streams 434 and 436. Stream 436 is expanded in expander 438, thus creating necessary refrigeration. The output of expander 438 is then condensed in upper reboiler-condenser 440 and the resulting stream 442 is divided into streams 444 and 446. Stream 444 is then fed to the top of the low pressure column 420 as reflux. Stream 446 is directed to the high pressure column as additional reflux. Because its pressure was reduced by prior expansion, however, stream 446 needs to be pumped using pump 450.

A column system for the production of high pressure nitrogen with nitrogen liquid reflux pumped from the low pressure column to the high pressure column has been described in U.S. Pat. No. 5,098,457, and it is shown in FIG. 5. In this arrangement, air is introduced to high pressure column 510 and high pressure nitrogen product is withdrawn from the top of this column as stream 515. High pressure column 510 is heat integrated with low pressure column 520 through reboiler-condenser 530. Nitrogen overhead from the top of low pressure column 520 is condensed in condenser 540 and a part of this condensate in stream 545 is pumped using pump 550 back to high pressure column 510 as additional reflux 560, thus increasing the recovery of high pressure nitrogen in stream 515.

BRIEF SUMMARY OF THE INVENTION

A goal of the present invention is to introduce low pressure nitrogen reflux into a distillation column that operates at a higher pressure without using pumps. More specifically, the present invention includes a method of separating air to produce nitrogen and/or oxygen in a system having at least one high pressure column, at least one low pressure column, and a reboiler-condenser, the method comprising the steps of generating a high pressure nitrogen stream from the high pressure column, and using energy from the high pressure nitrogen stream to provide nitrogen reflux to the high pressure column.

The method according to the present invention, more specifically, comprises generating a high pressure nitrogen vapor stream and condensing a portion of the high pressure nitrogen vapor stream to form a high pressure nitrogen liquid stream which is reduced in pressure by transferring it to a reflux vessel, where it is collected, then using a portion of the high pressure vapor stream not condensed to pressurize the reflux vessel to a pressure equal to the high pressure column and cause the nitrogen liquid collected therein to flow into the high pressure column under force of pressurization coupled with the static head of the nitrogen liquid. In an alternative embodiment, the high pressure nitrogen vapor stream may optionally be expanded prior to condensing it to form the low pressure nitrogen liquid stream. This stream, after expansion and condensing, may then be further reduced in pressure and transferred to the reflux vessel.

In an alternate embodiment, the method of the present invention comprises generating a high pressure nitrogen vapor stream, dividing the high pressure nitrogen vapor stream into two streams, one of which is condensed to form a nitrogen liquid stream, and the other of which is combined with the thus formed nitrogen liquid stream to form a two-phase mixture which is passed to a raised reflux vessel wherein the nitrogen liquid is collected and refluxed back to the high pressure column.

The present invention also provides a method of separating air to produce nitrogen and/or oxygen in a system having at least one high pressure column, at least one low pressure column, and a reboiler-condenser located in the bottom of the low pressure column, comprising the steps of generating a first high pressure nitrogen vapor stream and a second high pressure nitrogen vapor stream from the high pressure column, condensing the first high pressure nitrogen stream to form a high pressure nitrogen liquid stream, dividing the high pressure nitrogen liquid stream into a low pressure column liquid reflux stream and a high pressure column liquid reflux stream, and using the second high pressure nitrogen vapor stream to supply energy to cause the passage of the high pressure column liquid reflux stream to the high pressure column.

Another embodiment of the present invention comprises the steps of generating a high pressure nitrogen vapor stream from the high pressure column, dividing the high pressure nitrogen vapor stream from the generating step into a first high pressure nitrogen vapor stream and a second high pressure nitrogen vapor stream, condensing the first high pressure nitrogen vapor stream in a reboiler-condenser at the bottom of the low pressure column to form a high pressure nitrogen liquid stream, dividing the high pressure nitrogen liquid stream into a low pressure column liquid reflux stream and a high pressure column liquid reflux stream, and using the second high pressure nitrogen vapor stream to supply energy to cause the passage of the high pressure column liquid reflux stream to the high pressure column.

Still another embodiment comprises a method of separating air to produce nitrogen and/or oxygen in a system having at least one high pressure column, at least one low pressure column, and a condenser, the method comprising the steps of withdrawing a high pressure nitrogen vapor stream from the high pressure column, withdrawing a low pressure nitrogen vapor stream from the low pressure column, condensing the low pressure nitrogen vapor stream to form a low pressure nitrogen liquid stream, transferring the low pressure nitrogen liquid stream to a reflux vessel that is at a transfer pressure less than the pressure of the high pressure column, and passing a portion of the high pressure nitrogen vapor stream to the reflux vessel to increase the pressure within the reflux vessel to a pressure equal to the high pressure column whereby the nitrogen liquid in the reflux vessel is passed to the high pressure column.

Yet another embodiment of the present invention is a system for separating air to produce nitrogen and/or oxygen comprising a high pressure column for producing a first high pressure nitrogen vapor stream and a second high pressure nitrogen vapor stream, a low pressure column for producing a low pressure nitrogen vapor product stream, a condenser to receive the first high pressure nitrogen stream to form a high pressure nitrogen liquid stream, and at least two reflux vessels in fluid communication with the high pressure column for receiving the high pressure nitrogen liquid stream from the condenser, wherein the second high pressure nitrogen vapor stream is in fluid communication with the at least two reflux vessels to provide pressurization of the vessels.

Still yet another embodiment is a system for separating air to produce nitrogen and/or oxygen comprising a high pressure column for producing a first high pressure nitrogen vapor stream, a low pressure column for producing a low pressure nitrogen vapor product stream, a condenser to receive the first high pressure nitrogen stream to form a high pressure nitrogen liquid stream, and a reflux vessel in fluid communication with the high pressure column for receiving the high pressure nitrogen liquid stream from the condenser, wherein the reflux vessel is disposed above the high pressure column at a height sufficient to generate a static head pressure necessary to deliver the high pressure nitrogen liquid stream from the reflux vessel to the top of the high pressure column.

Yet still another embodiment of the present invention is a system for separating air to produce nitrogen and/or oxygen, comprising a high pressure column for producing a high pressure nitrogen vapor stream, a low pressure column for producing a low pressure nitrogen vapor product stream, a condenser to condense the low pressure nitrogen vapor product stream, and a reflux vessel in fluid communication with both columns for receiving the low pressure nitrogen liquid stream from the low pressure column and the high pressure nitrogen vapor stream from the high pressure column, wherein the reflux vessel is disposed above the high pressure column at a height sufficient to generate a static head pressure necessary to deliver the high pressure nitrogen liquid stream from the reflux vessel to the top of the high pressure column.

DETAILED DESCRIPTION OF THE INVENTION

The present invention finds primary utility in a cryogenic air separation process for oxygen and nitrogen production. The invention provides a method of transferring nitrogen liquid as a reflux to a column that is at a higher pressure than the nitrogen liquid, where energy from the higher-pressure nitrogen vapor is used to facilitate the transfer. The higher-pressure nitrogen vapor has a pressure not lower than the pressure on top of the column to which the nitrogen liquid is transferred.

One embodiment of the current invention includes the separation of air in a system of columns having at least one high pressure column and at least one low pressure column built side-by-side, and a reboiler-condenser located in the bottom of the low pressure column. High pressure nitrogen liquid is transferred by a pressure difference to a reflux vessel that is at a lower pressure during the transfer. When this high-pressure nitrogen reaches the vessel, its pressure is reduced by the pressure drop necessary for the transfer. After the transfer, the pressure of the reflux vessel is increased by introduction of high pressure nitrogen vapor, preferably from the top of the high pressure column, thus allowing the nitrogen liquid to be returned to the high pressure column as reflux. In this configuration, high pressure nitrogen vapor is condensed in the reboiler-condenser to supply the necessary boilup for the low pressure column and to form high pressure nitrogen liquid.

Figure 6:
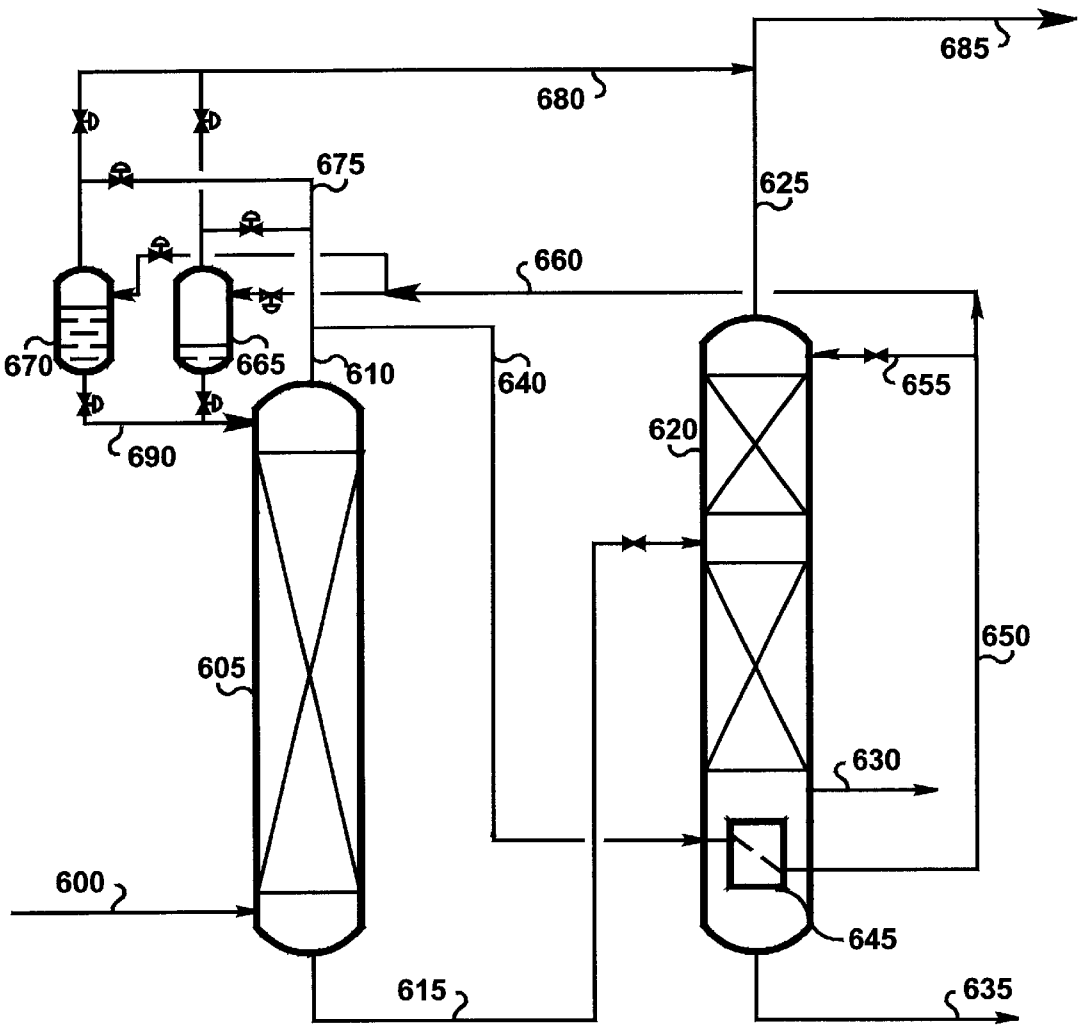
FIG. 6 is a schematic illustration of an embodiment of the present invention where two reflux vessels are disposed above the top of the high pressure column to increase the potential energy of the nitrogen liquid from the low pressure column.

Although it is possible to use just one vessel, it is often more convenient to use two or more reflux vessels. In such an arrangement (as shown in FIG. 6), two reflux vessels are used and one of the vessels is filled while the other supplies reflux to the high pressure column. Through this rotation, the high pressure column receives continuous, uninterrupted flow of nitrogen liquid reflux. These vessels may operate in series or in parallel. Alternatively, the two vessels may be contained within one larger vessel forming compartments, separated by dividing walls.

A more detailed description of the preferred embodiment of the current invention is now discussed with reference to FIG. 6. Compressed air, purified from water and carbon dioxide and cooled to a cryogenic temperature, is introduced as stream 600 to high pressure column 605. Compressed air stream 600 is separated in column 605 into a high pressure nitrogen vapor overhead vapor stream 610, and an oxygen enriched liquid stream 615. Oxygen enriched liquid stream 615 carries a liquid mixture of oxygen and nitrogen to low pressure column 620, where it is separated into the final products, including gaseous oxygen product stream 630, and/or liquid oxygen product stream 635.

A portion of high pressure nitrogen overhead vapor stream 610 is fed as stream 640 to reboiler-condenser 645 in column 620, where it is condensed to form nitrogen liquid stream 650. A portion of nitrogen liquid stream 650 is supplied as reflux to low pressure column 620 as stream 655, and the remaining portion (stream 660) is fed in turn to reflux vessels 665 and 670.

Important to the invention is the periodic switching of stream 660 to fill vessels 665 and 670 with nitrogen liquid to provide a constant source of nitrogen liquid to the top of high pressure column 605. Specifically, while one vessel, e.g. 670, is being filled, the other, e.g. 665, is emptying its nitrogen liquid to the top of high pressure column 605.

For example, while vessel 665 is filled with nitrogen liquid from stream 660, displaced nitrogen vapor is vented from vessel 665 via nitrogen vapor stream 680 to be combined with nitrogen stream 625 to form low-pressure nitrogen product stream 685. At the same time, while vessel 665 is filling with nitrogen liquid, high pressure nitrogen vapor is introduced to vessel 670 (which has already been filled with nitrogen liquid) via nitrogen vapor stream 675 to increase the pressure in vessel 670 and cause the nitrogen liquid therein to drain into high pressure column 605 via nitrogen liquid stream 690. Once vessel 670 is emptied and vessel 665 is filled, nitrogen liquid from stream 660 is directed to vessel 670 and high pressure nitrogen vapor from stream 675 is passed into vessel 665 causing its pressure to increase which causes its nitrogen liquid to drain into the high pressure column via nitrogen liquid stream 690. This alternating filling/pressurizing/draining process continues and results in a constant supply of nitrogen to high pressure column 605. The high pressure nitrogen stream used to pressurize each of the vessels brings those vessels to the same pressure as the high pressure column. That pressurization, coupled with the head of the liquid in each vessel, causes those vessels to empty (when the appropriate valves are opened) into the high pressure column as reflux.

During the process of filling and emptying vessels 665, 670, it is preferred that each vessel is filled with high pressure nitrogen vapor before it is refilled with nitrogen liquid from stream 660. The nitrogen which is purged from each vessel 665, 670 may be vented via nitrogen vapor stream 680 or it could be expanded (not shown) in the low-pressure nitrogen product stream 685, to recover refrigeration.

In an alternative arrangement from that shown in FIG. 6, the system may also contain a side rectifier off low pressure column 620 to produce argon. This modification is not shown in FIG. 6.

In still yet another embodiment of the present invention, high pressure nitrogen liquid may also be transferred to a reflux vessel using high pressure nitrogen vapor vapor lift. In a vapor lift transfer, high-pressure nitrogen vapor is injected into a nitrogen liquid stream to form cavities of nitrogen vapor within the nitrogen liquid (in other words, bubbling nitrogen vapor into the nitrogen liquid). The bubbles travel up the nitrogen liquid stream and some of the nitrogen liquid is carried with them. In effect, the introduction of the nitrogen vapor creates a two-phase mixture. The nitrogen vapor (bubbles) becomes disengaged from the liquid when the two-phase mixture reaches the reflux vessel. The reflux vessel is located high enough in the system so that nitrogen liquid can be returned back to the high pressure column at a sufficiently high pressure achieved by using static head. Such an arrangement is shown schematically in FIG. 7.

Figure 7:
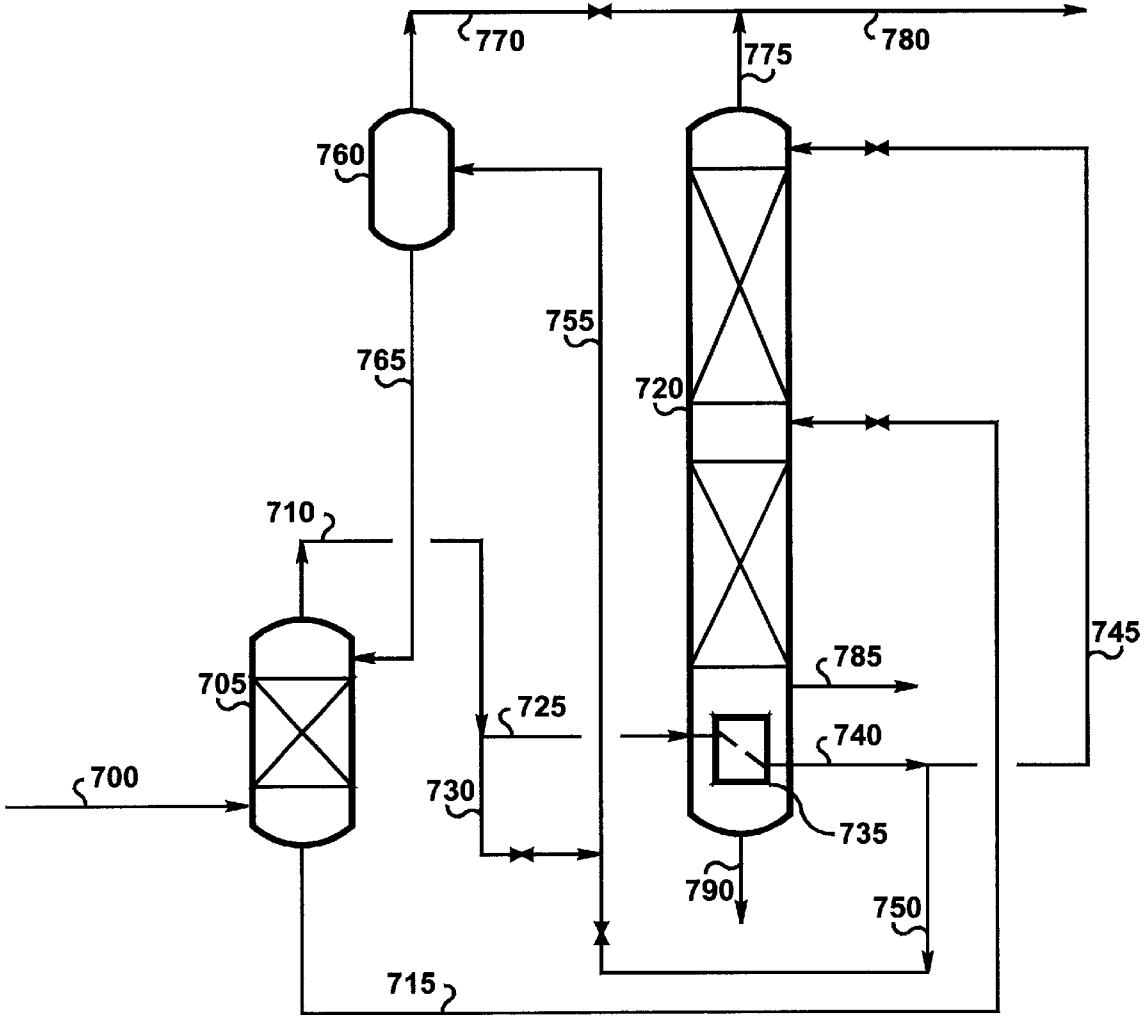
FIG. 7 is a schematic illustration of another embodiment of the present invention where high pressure nitrogen vapor from the high pressure column is used to vapor lift nitrogen liquid from the low pressure column to a reflux vessel.

Referring to FIG. 7, a compressed air stream 700, purified from water and carbon dioxide and cooled down to a cryogenic temperature, is introduced to high pressure column 705. The compressed air stream 700 is separated in column 705 into high-pressure nitrogen overhead vapor stream 710 and oxygen enriched liquid stream 715. Oxygen enriched liquid stream 715 is fed to low pressure column 720. High pressure nitrogen vapor stream 710 is divided into two streams: major stream 725 and minor stream 730. The high pressure nitrogen vapor in major stream 725 is condensed in reboiler-condenser 735, thus providing boilup for low pressure column 720. Condensed nitrogen liquid stream 740 leaving reboiler-condenser 735 is divided into two streams: low pressure column 720 reflux nitrogen liquid stream 745 and high pressure column 705 reflux nitrogen liquid stream 750. High pressure column 705 reflux nitrogen liquid stream 750 is first passed to reflux vessel 760 via stream 755. Reflux is fed from the raised reflux vessel 760 to high pressure column 705 via nitrogen liquid stream 765 using static head.

High pressure nitrogen vapor is injected into nitrogen liquid stream 750 from reboiler-condenser 735 via high pressure nitrogen vapor stream 730, providing vapor lift in nitrogen liquid stream 750 to form two-phase nitrogen stream 755. The high pressure nitrogen vapor is separated from nitrogen liquid in vessel 760. Low pressure nitrogen vapor stream 770 exiting the top of reflux vessel 760 joins low pressure nitrogen vapor stream 775 to yield a final low-pressure nitrogen vapor product stream 780. The other products from the low pressure column 720 are gaseous oxygen stream 785 and/or liquid oxygen stream 790. High pressure column 705 is then fed high pressure nitrogen liquid from vessel 760 under the force of gravity; i.e. sufficient static head is generated in vessel 760 to provide nitrogen liquid to column 705.

In the embodiments shown in FIGS. 1–5, high pressure nitrogen vapor is used to increase the potential energy of the nitrogen liquid. In the case of the embodiment shown in FIG. 6, this is done by increasing the pressure in the reflux vessel(s). In the case of the embodiment shown in FIG. 7, this is accomplished by providing a vapor lift. In both cases, the high pressure nitrogen vapor is ultimately vented to the low pressure nitrogen vapor liquid stream. The lost pressure of the high pressure nitrogen vapor provides the energy for nitrogen liquid transfer. Part of this energy can be recovered by using an expander (not shown).

The present invention may also be used in other column arrangements, such as the one shown above in FIG. 4, where high pressure nitrogen vapor is expanded, prior to its condensation, and nitrogen liquid at an intermediate pressure is transferred back to the high-pressure column as a reflux. Alternatively, the present invention could be used in the column arrangement illustrated in FIG. 5, to transfer nitrogen reflux from the low-pressure column to the high pressure column without a pump. These embodiments are discussed in more detail below.

Figure 1:
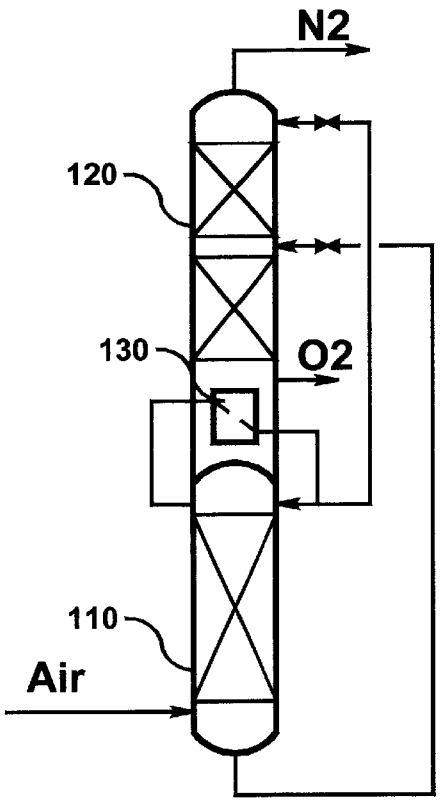
FIG. 1 is a schematic illustration of a one column arrangement according to the prior art.
Figure 2:
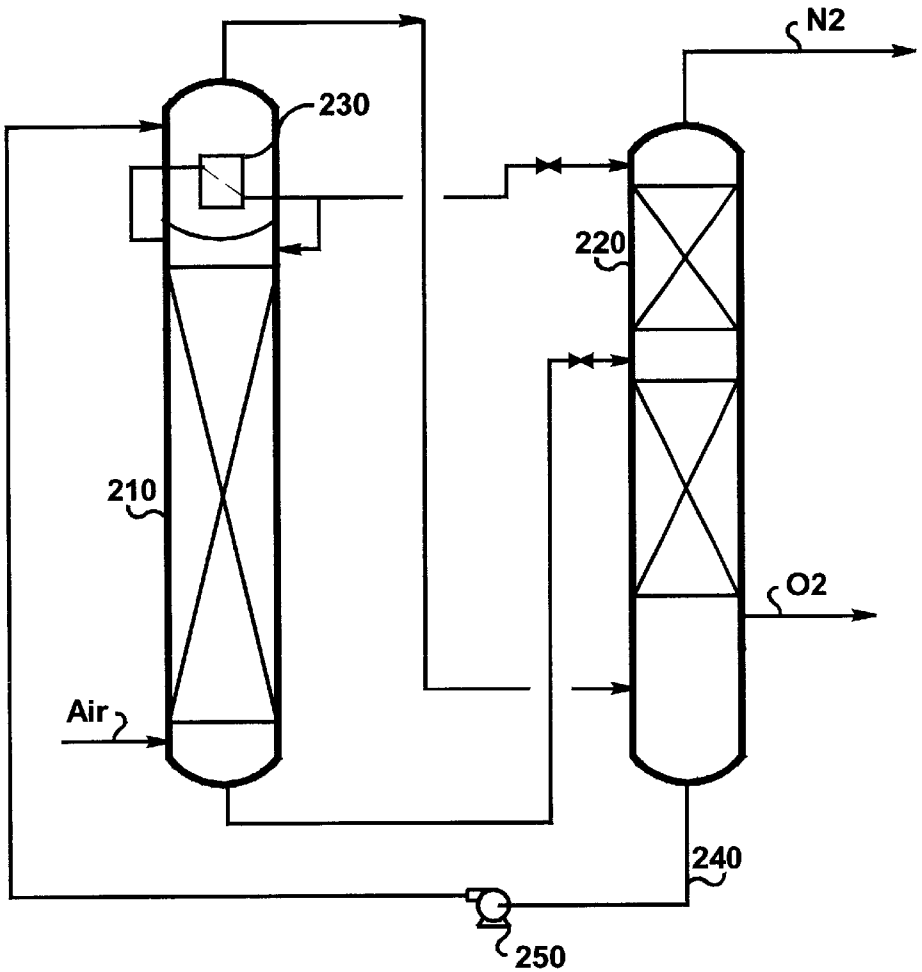
FIG. 2 is a schematic illustration of a side-by-side arrangement according to the prior art.
Figure 3:
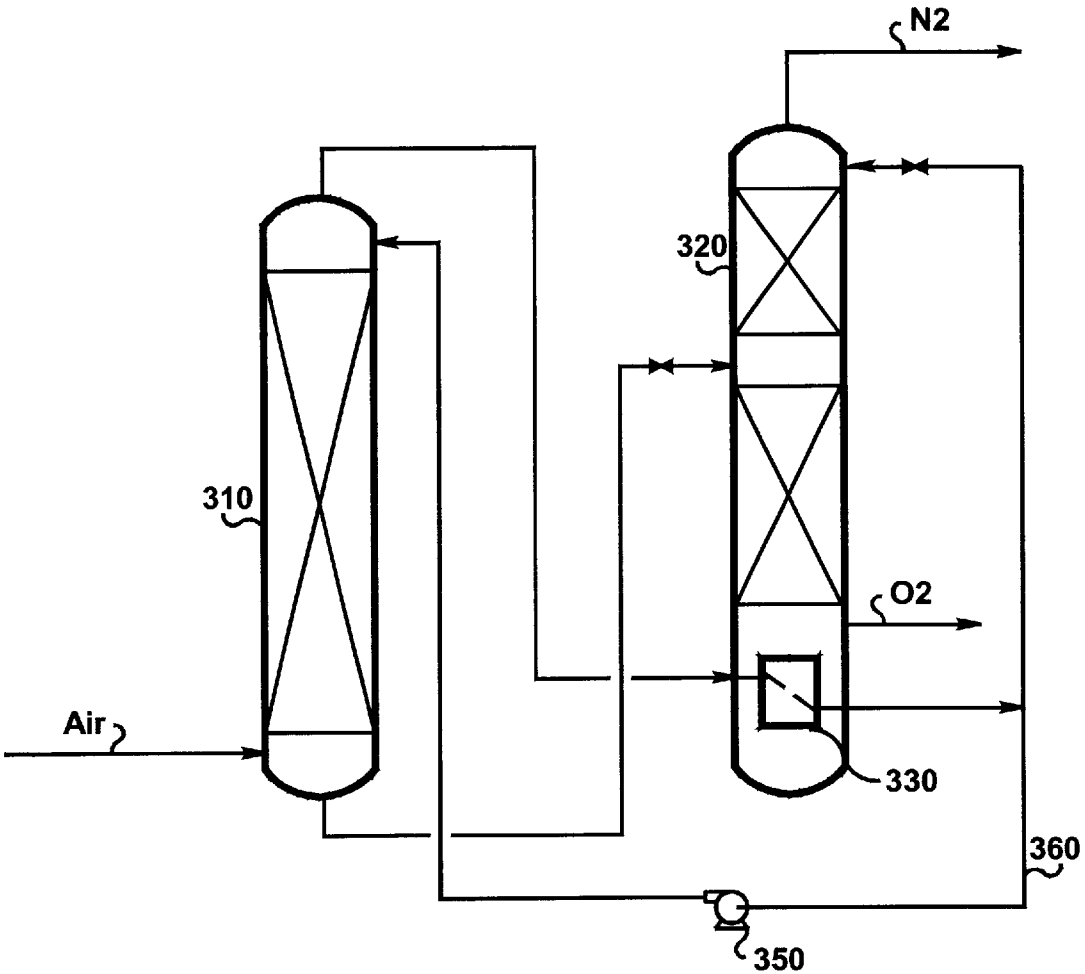
FIG. 3 is a schematic illustration of an alternative side-by-side arrangement according to the prior art.
Figure 4:
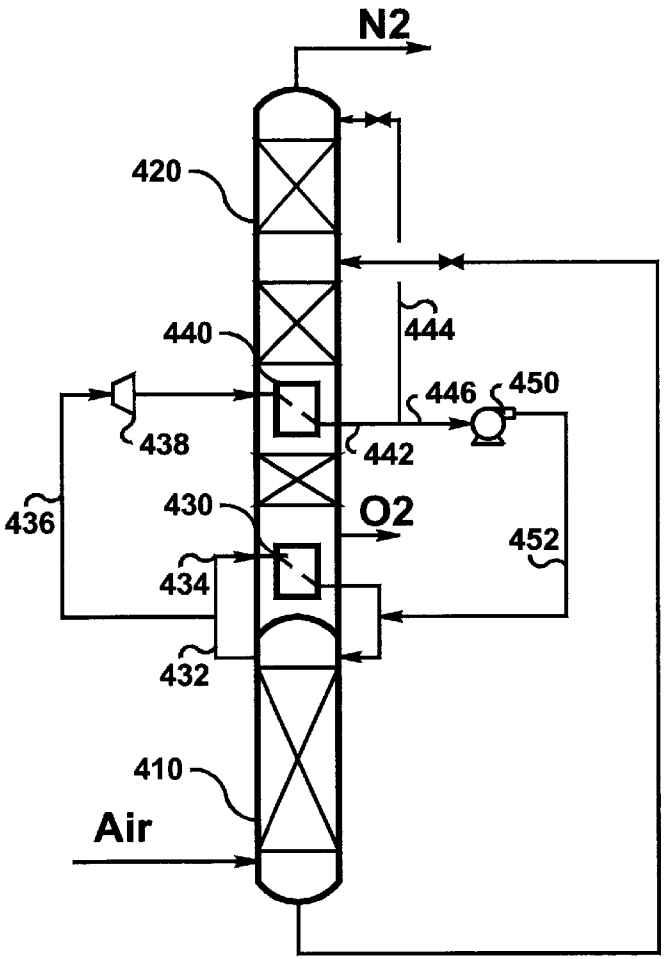
FIG. 4 is a schematic illustration of an alternative one column arrangement according to the prior art.
Figure 8:
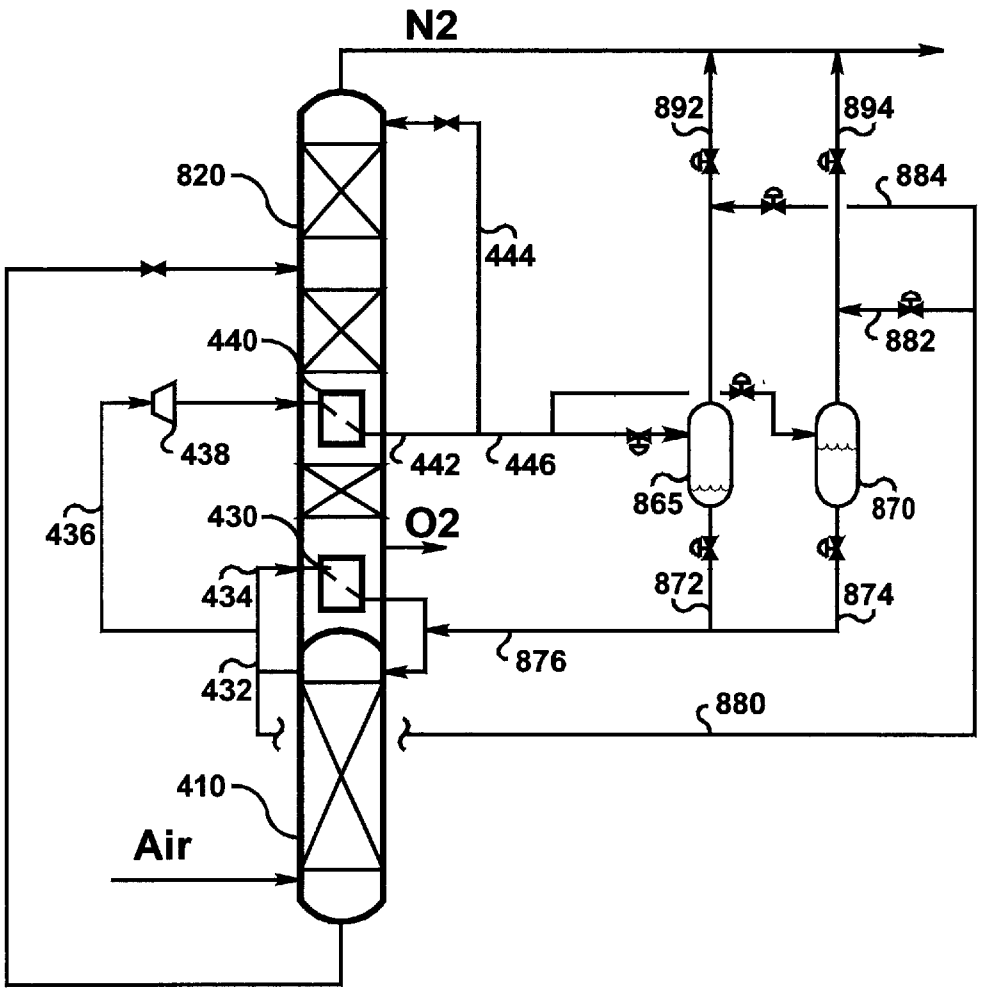
FIG. 8 is a schematic illustration of an alternative embodiment of the present invention where two reflux vessels are disposed above the top of the high pressure column in a one column arrangement to increase the potential energy of the nitrogen liquid from the low pressure column.

FIG. 8 shows the column system for production of nitrogen and/or oxygen, with nitrogen expansion and a dual reboiler as in FIG. 4, except that the nitrogen liquid pump 450 has been replaced by reflux vessels 865, 870 and associated valves and lines. As described previously in reference to FIG. 6, these two tanks work intermittently, i.e., one of them is being filled with nitrogen liquid while the other is drained to the high pressure column via line 872 or 874, connecting to line 876. High-pressure nitrogen gas is provided to each vessel intermittently (to increase its pressure) from the top of high pressure column 410 via line 880 and then 882 or 884. Lower pressure nitrogen is vented intermittently via lines 892 and 894 (while each corresponding vessel is filled).

Figure 9:
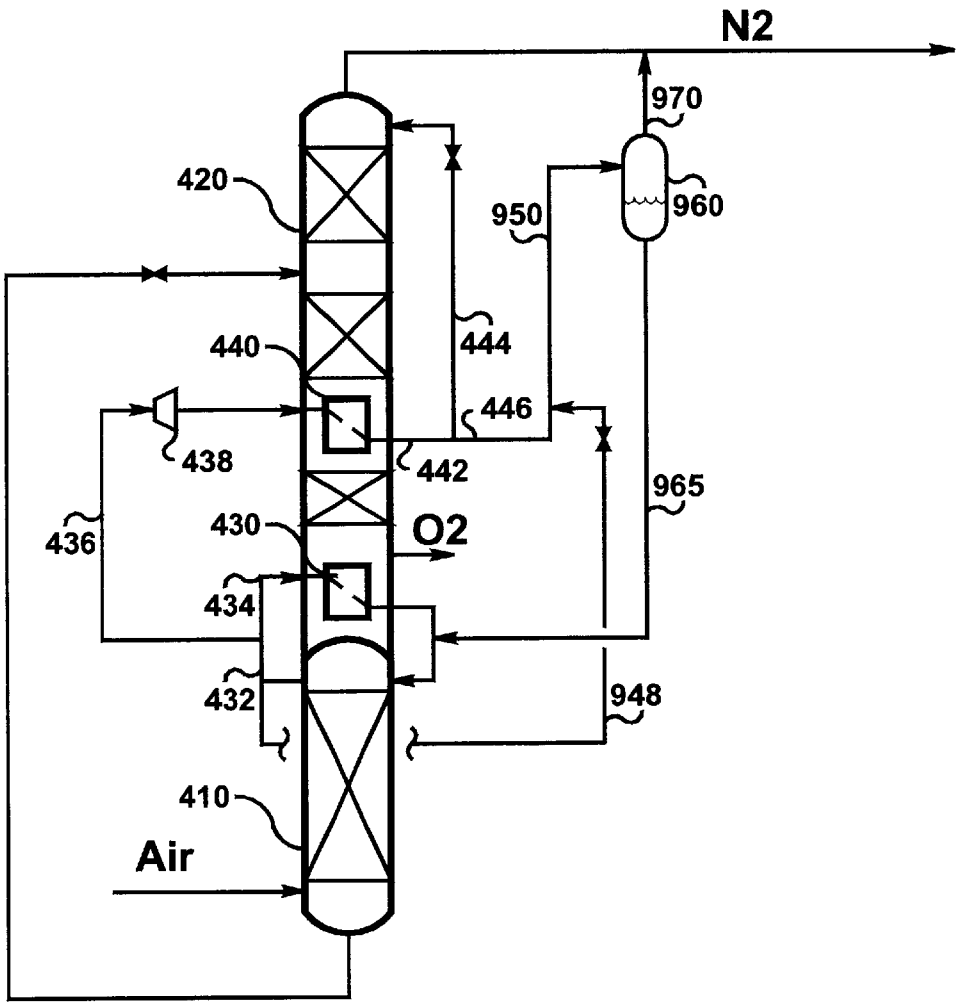
FIG. 9 is a schematic illustration of another embodiment of the present invention where high pressure nitrogen vapor from the high pressure column is used to vapor lift nitrogen liquid from the low pressure column to a reflux vessel.

FIG. 9 shows the column system for production of nitrogen and/or oxygen, with nitrogen expansion and a dual reboiler as in FIG. 4, except that the nitrogen liquid pump 450 has been replaced by tank 960 and associated lines. As described previously in reference to FIG. 7, low pressure nitrogen liquid in line 446 is "vapor lifted" by high pressure nitrogen vapor in line 948 up line 950 to vessel 960. In vessel 960, both phases separate; vapor phase leaves from the top in line 970; liquid phase is fed back (utilizing static pressure) to high pressure column 410 via line 965 as reflux.

Figure 5:
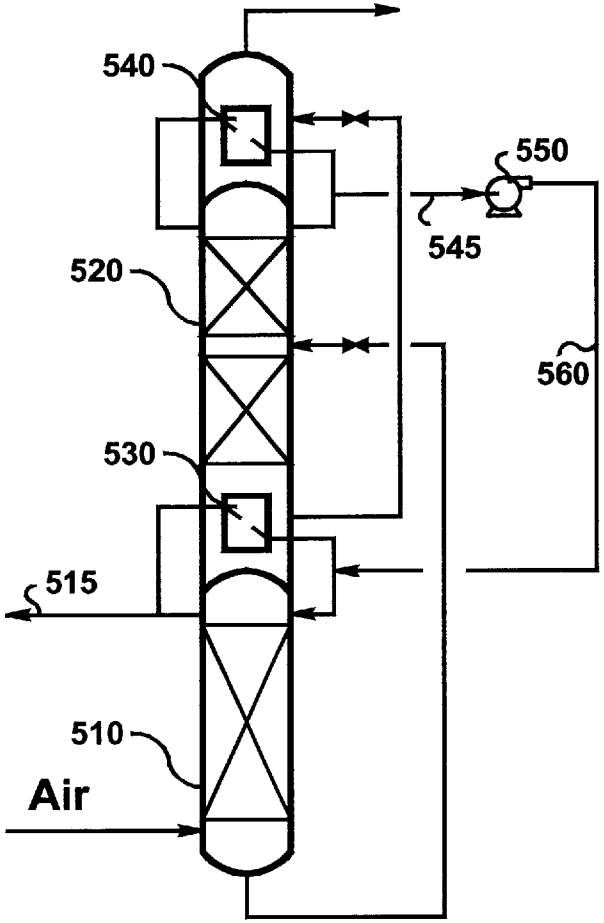
FIG. 5 is a schematic illustration of still another one column arrangement according to the prior art.
Figure 10:
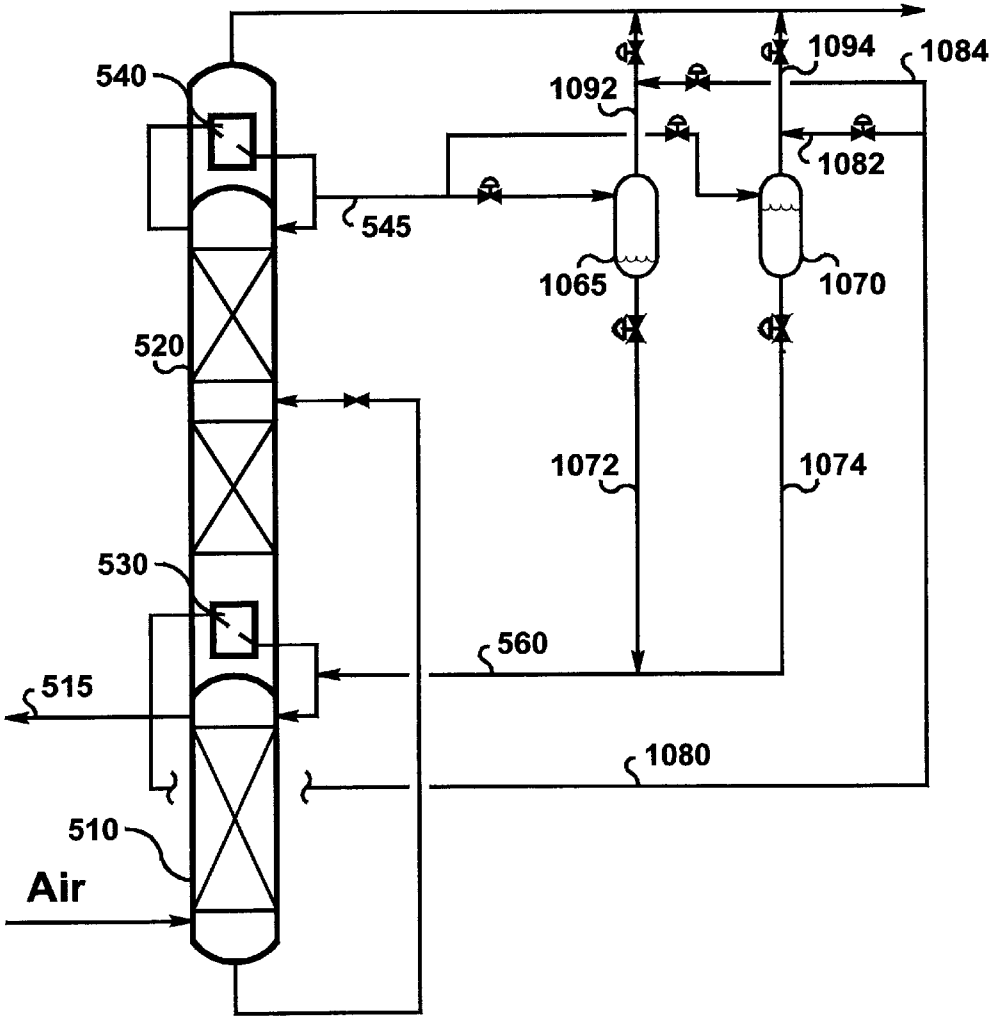
FIG. 10 is a schematic illustration of still another embodiment of the present invention where two reflux vessels are disposed above the top of the high pressure column in a one column arrangement to increase the potential energy of the nitrogen liquid from the low pressure column.

FIG. 10 shows the column system for production of nitrogen, with nitrogen liquid transferred from low pressure column 520 to high pressure column 510, as in FIG. 5, except that the nitrogen liquid pump 550 of FIG. 5 has been replaced by tanks 1065, 1070 and associated valves and lines. As described previously with reference to FIG. 6, these two tanks work intermittently, i.e., one of them is being filled with nitrogen liquid, while the other is drained to the high pressure column via line 1072 or 1074, connecting to line 560. High-pressure nitrogen gas is provided to each vessel intermittently (to increase its pressure) from the top of the high pressure column via line 1080 and then 1082 or 1084. Lower pressure nitrogen is vented intermittently via lines 1092 and 1094 (while each corresponding vessel is filled).

It has been determined that for the embodiment of the invention illustrated in FIG. 6, the power used for transferring nitrogen liquid is about 0.6% of MAC (main air compressor) power, or 155 kW for a plant producing 2700 short tons of oxygen per day. The capital cost of the reflux tanks depends on their size and the size is a function of the plant size and the frequency of switching. Some examples of tank sizes are given in Table 1.

TABLE 1

Reflux tank volume ($m^3$) as a function of plant size and the frequency of switching between the tanks

| Time, | Oxygen production, short ton/day | | | |
|---|---|---|---|---|
| minutes | 300 | 700 | 1500 | 2700 |
| 30 | 23.5 | 54.8 | 117.5 | 211.5 |
| 20 | 15.7 | 36.6 | 78.3 | 141.0 |
| 10 | 7.8 | 18.3 | 39.2 | 70.5 |
| 5 | 3.9 | 9.1 | 19.6 | 35.3 |
| 1 | 0.8 | 1.8 | 3.9 | 7.0 |

The present invention has been set forth with regard to several preferred embodiments, but the full scope of the invention should be ascertained by the claims that follow.

What is claimed is:

1. A method of separating air to produce nitrogen and/or oxygen in a system having at least one high pressure column, at least one low pressure column, and a reboiler-condenser, comprising the steps of:

(a) generating a high pressure nitrogen vapor stream from the high pressure column; and (b) using energy from the high pressure nitrogen vapor stream to provide nitrogen reflux to the high pressure column by condensing a portion of the high pressure nitrogen vapor stream to form a high pressure nitrogen liquid stream which is collected in a vessel, and a portion of the high pressure nitrogen vapor stream not condensed is used to pressurize the vessel to cause the high pressure nitrogen liquid collected in the vessel to flow into the high pressure column.

2. The method of claim 1 wherein step (b) comprises dividing the high pressure nitrogen vapor stream into two streams, condensing one of the high pressure nitrogen vapor streams to form said high pressure nitrogen liquid stream, and combining the other high pressure nitrogen vapor stream with the high pressure nitrogen liquid stream to form a two-phase mixture, passing the two phase mixture to a reflux vessel, refluxing nitrogen liquid collected in the reflux vessel back to the high pressure column under the force created by a static head in the reflux vessel.

3. A method of separating air to produce nitrogen and/or oxygen using a system having at least one high pressure column, at least one low pressure column, and a reboiler-condenser, comprising the steps of:

(a) removing a first high pressure nitrogen vapor stream and a second high pressure nitrogen vapor stream from the high pressure column;

(b) condensing the first high pressure nitrogen vapor stream to form a high pressure nitrogen liquid stream;

(c) dividing the high pressure nitrogen liquid stream into a low pressure column liquid reflux stream and a high pressure column liquid reflux stream; and (d) using the second high pressure nitrogen vapor stream to supply energy to cause passage of the high pressure column liquid reflux stream to the high pressure column.

4. The method of claim 3 further comprising, between steps (a) and (b), the step of expanding the first high pressure nitrogen vapor stream.

5. The method of claim 3 wherein step (d) comprises the steps of:

transferring the high pressure column liquid reflux stream to a reflux vessel that is at a transfer pressure less than the pressure of the high pressure column; and passing the second high pressure nitrogen vapor stream to the reflux vessel to increase the pressure within the reflux vessel to a pressure equal to the high pressure column whereby the nitrogen liquid in the reflux vessel is passed to the high pressure column.

6. The method of claim 3 wherein step (d) comprises the steps of:

(1) transferring the high pressure column liquid reflux stream into a first reflux vessel that is at a transfer pressure less than the pressure of the high pressure column;

(2) passing the second high pressure nitrogen vapor stream into the first reflux vessel to increase the pressure within the first reflux vessel to a pressure equal to the high pressure column whereby the nitrogen liquid in the first reflux vessel is passed to the high pressure column;

(3) transferring the high pressure column liquid reflux stream into a second reflux vessel that is at a transfer pressure less than the pressure of the high pressure column while the pressure is increased on the first reflux vessel;

(4) passing the second high pressure nitrogen vapor stream into the second reflux vessel to increase the pressure within the second reflux vessel to a pressure equal to the high pressure column whereby the nitrogen liquid in the second reflux vessel is passed to the high pressure column while the high pressure column liquid reflux stream is passed into the first reflux vessel; and repeating steps 1–4 whereby a constant supply of nitrogen liquid is supplied as reflux to the high pressure column.

7. The method of claim 3 wherein step (d) comprises the steps of:

combining the second high pressure nitrogen vapor stream and the high pressure column liquid reflux stream into a two-phase stream;

passing the two-phase stream to a reflux vessel; and transferring the nitrogen liquid accumulated in the reflux vessel from the high pressure column liquid reflux stream to the high pressure column as reflux.

8. The method of claim 7 including the step of passing the nitrogen liquid accumulated in the reflux vessel to the high pressure column under a static head of nitrogen liquid accumulated in the reflux vessel.

9. A method of separating air to produce nitrogen and/or oxygen in a system having at least one high pressure column, at least one low pressure column, and a reboiler-condenser located in the bottom of the low pressure column, comprising the steps of:

(a) removing a high pressure nitrogen vapor stream from the high pressure column;

(b) dividing the high pressure nitrogen vapor stream from step (a) into a first high pressure nitrogen vapor stream and a second high pressure nitrogen vapor stream;

(c) condensing the first high pressure nitrogen vapor stream in the reboiler-condenser in the low pressure column to form a high pressure nitrogen liquid stream;

(d) dividing the high pressure nitrogen liquid stream into a low pressure column liquid reflux stream and a high pressure column liquid reflux stream; and (e) using the second high pressure nitrogen vapor stream to supply energy to cause the passage of the high pressure column liquid reflux stream to the high pressure column.

10. The method of claim 9 wherein step (e) comprises the steps of:

transferring the high pressure column liquid reflux stream to a reflux vessel that is at a transfer pressure less than the pressure of the high pressure column; and passing the second high pressure nitrogen vapor stream to the reflux vessel to increase the pressure within the reflux vessel to a pressure equal to the high pressure column whereby the nitrogen liquid in the reflux vessel is passed to the high pressure column.

11. The method of claim 9 further comprising, between steps (b) and (c), the step of expanding the first high pressure nitrogen vapor stream.

12. The method of claim 9 wherein step (e) comprises the steps of:

(1) transferring the high pressure column liquid reflux stream to a first reflux vessel that is at a transfer pressure less than the pressure of the high pressure column;

(2) passing the second high pressure nitrogen vapor stream into the first reflux vessel to increase the pressure within the first reflux vessel to a pressure equal to the high pressure column whereby the nitrogen liquid in the first reflux vessel is passed to the high pressure column;

(3) transferring the high pressure column liquid reflux stream to a second reflux vessel that is at a transfer pressure less than the pressure of the high pressure column while the pressure is increased on the first reflux vessel;

(4) passing the second high pressure nitrogen vapor stream into the second reflux vessel to increase the pressure within the second reflux vessel to a pressure equal to the high pressure column whereby the nitrogen liquid in the second reflux vessel is passed to the high pressure column while the high pressure column liquid reflux stream is passed into the first reflux vessel; and repeating steps 1–4 whereby a constant supply of nitrogen liquid is supplied as reflux to the high pressure column.

13. The method of claim 9 wherein step (e) comprises the steps of:

combining the second high pressure nitrogen vapor stream and the high pressure column liquid reflux stream into a two-phase stream;

passing the two-phase stream to a reflux vessel;

recovering from the top of the reflux vessel the nitrogen vapor; and transferring the nitrogen liquid accumulated in the reflux vessel from the high pressure column liquid reflux stream to the high pressure column as reflux.

14. The method of claim 13 wherein the transferring step occurs under a static head of nitrogen liquid accumulated in the reflux vessel.

15. A method of separating air to produce nitrogen and/or oxygen in a system having at least one high pressure column, at least one low pressure column, and a reboiler-condenser located in the bottom of the low pressure column, the method comprising the steps of:

(a) withdrawing a high pressure nitrogen vapor stream from the high pressure column;

(b) dividing the high pressure nitrogen vapor stream from step (a) into a first high pressure nitrogen vapor stream and a second high pressure nitrogen vapor stream;

(c) condensing the first high pressure nitrogen vapor stream in a reboiler-condenser at the bottom of the low pressure column to form a high pressure nitrogen liquid stream;

(d) dividing the high pressure nitrogen liquid stream into a low pressure column reflux stream and a high pressure column reflux stream;

(e) transferring the high pressure column liquid reflux stream to a reflux vessel that is at a transfer pressure less than the pressure of the high pressure column; and (f) passing the second high pressure nitrogen vapor stream to the reflux vessel to increase the pressure within the reflux vessel to a pressure equal to the high pressure column whereby the nitrogen liquid in the reflux vessel is passed to the high pressure column.

16. The method in claim 15 wherein steps (e) and (f) further comprise the steps of:

(1) transferring the high pressure column liquid reflux stream to a first reflux vessel that is at a transfer pressure less than the pressure of the high pressure column;

(2) passing the second high pressure nitrogen vapor stream into the first reflux vessel to increase the pressure within the first reflux vessel to a pressure equal to the high pressure column whereby the nitrogen liquid in the first reflux vessel is passed to the high pressure column;

(3) transferring the high pressure column liquid reflux stream to a second reflux vessel that is at a transfer pressure less than the pressure of the high pressure column while the pressure is increased on the first reflux vessel;

(4) passing the second high pressure nitrogen vapor stream into the second reflux vessel to increase the pressure within the first reflux vessel to a pressure equal to the high pressure column whereby the nitrogen liquid in the second reflux vessel is passed to the high pressure column while the high pressure column liquid reflux stream is passed into the first reflux vessel; and repeating steps 1–4 whereby a constant supply of nitrogen liquid is supplied as reflux to the high pressure column.

17. A method of separating air to produce nitrogen and/or oxygen in a system having at least one high pressure column, at least one low pressure column, and a reboiler-condenser located in the bottom of the low pressure column, the method comprising the steps of:

(a) withdrawing a high pressure nitrogen vapor stream from the high pressure column;

(b) dividing the high pressure nitrogen vapor stream from step (a) into a first high pressure nitrogen vapor stream and a second high pressure nitrogen vapor stream;

(c) condensing the first high pressure nitrogen vapor stream in a reboiler-condenser at the bottom of the low pressure column to form a high pressure nitrogen liquid stream;

(d) dividing the high pressure nitrogen liquid stream into a low pressure column liquid reflux stream and a high pressure column liquid reflux stream;

(e) combining the second high pressure nitrogen vapor stream and the high pressure column liquid reflux stream into a two-phase stream;

(f) passing the two-phase stream to a reflux vessel;

(g) recovering nitrogen vapor from the top of the reflux vessel; and (h) allowing the nitrogen liquid accumulated in the reflux vessel from the high pressure column liquid reflux stream to pass to the high pressure column as reflux under a static head of nitrogen liquid accumulated in the reflux vessel.

18. A method of separating air to produce nitrogen and/or oxygen in a system having at least one high pressure column, at least one low pressure column, and a condenser, the method comprising the steps of:

(a) withdrawing a high pressure nitrogen vapor stream from the high pressure column;

(b) withdrawing a low pressure nitrogen vapor stream from the low pressure column;

(c) condensing the low pressure nitrogen vapor stream to form a low pressure nitrogen liquid stream;

(d) transferring the low pressure nitrogen liquid stream to a reflux vessel that is at a transfer pressure less than the pressure of the high pressure column; and (e) passing a portion of the high pressure nitrogen vapor stream to the reflux vessel to increase the pressure within the reflux vessel to a pressure equal to the high pressure column whereby the nitrogen liquid in the reflux vessel is passed to the high pressure column.

19. The method of claim 18 wherein the high pressure nitrogen vapor stream withdrawn from the high pressure column in step (a) is divided into a first and second stream, the first stream being condensed in a reboiler-condenser located above the high pressure column and returned to the high pressure column as reflux.

20. The method of claim 18 wherein the low pressure nitrogen vapor stream withdrawn from the low pressure column in step (b) is condensed in a condenser located above the low pressure column and then divided into two streams, a first stream which is returned to the low pressure column as reflux, and a second stream which is transferred in step (d).

21. A system for separating air to produce nitrogen and/or oxygen, comprising:

(a) a high pressure column for producing a first high pressure nitrogen vapor stream and a second high pressure nitrogen vapor stream;

(b) a low pressure column for producing a low pressure nitrogen vapor product stream;

(c) a condenser to receive the first high pressure nitrogen vapor stream to form a high pressure nitrogen liquid stream; and (d) at least two reflux vessels in fluid communication with said high pressure column for receiving the high pressure nitrogen liquid stream from said condenser;

wherein the second high pressure nitrogen vapor stream is in fluid communication with said at least two reflux vessels to provide pressurization of said vessels.

22. The system of claim 21 wherein said condenser is located in the bottom of said low pressure column.

23. A system for separating air to produce nitrogen and/or oxygen, comprising:

(a) a high pressure column for producing a high pressure nitrogen vapor stream;

(b) a low pressure column for producing a low pressure nitrogen vapor stream, (c) a condenser to receive the high pressure nitrogen vapor stream to form a high pressure nitrogen liquid stream; and (d) a reflux vessel in fluid communication with said high pressure column for receiving the high pressure nitrogen liquid stream from said condenser;

wherein said reflux vessel is disposed above said high pressure column at a height sufficient to generate a static head pressure necessary to deliver the high pressure nitrogen liquid stream from said reflux vessel to the top of said high pressure column.

24. The system of claim 23 wherein said condenser is located in the bottom of said low pressure column.

25. A system for separating air to produce nitrogen and/or oxygen, comprising:

(a) a high pressure column for producing a high pressure nitrogen vapor stream;

(b) a low pressure column for producing a low pressure nitrogen vapor stream, (c) a condenser to condense the low pressure nitrogen vapor product stream, and (d) a reflux vessel in fluid communication with both columns for receiving the low pressure nitrogen liquid stream from the low pressure column and the high pressure nitrogen vapor stream from the high pressure column;

wherein said reflux vessel is disposed above said high pressure column at a height sufficient to generate a static head pressure necessary to deliver the high pressure nitrogen liquid stream from said reflux vessel to the top of said high pressure column.

* * * * *